United States Patent [19]

Graser

[11] 4,022,372

[45] May 10, 1977

[54] ARTICLE CARRIER

[75] Inventor: Earl J. Graser, Monroe, La.

[73] Assignee: Olinkraft, Inc., West Monroe, La.

[22] Filed: Aug. 5, 1976

[21] Appl. No.: 711,887

[52] U.S. Cl. ..... 229/40; 229/15

[51] Int. Cl.[2] ..... B65D 5/02; B65D 75/08

[58] Field of Search ..... 206/157, 180, 190, 193; 229/15, 40, 28 BC

[56] References Cited

UNITED STATES PATENTS

| | | | |
|---|---|---|---|
| 2,314,895 | 3/1943 | Powell | 229/31 |
| 2,834,530 | 5/1958 | Nute | 229/15 X |
| 3,014,636 | 12/1961 | Fielding | 229/40 X |
| 3,294,280 | 12/1966 | Graser | 229/40 X |
| 3,337,045 | 8/1967 | Morgese | 229/40 UX |
| 3,356,283 | 12/1967 | Champlin | 229/40 |
| 3,478,947 | 11/1969 | Schillinger | 229/15 |
| 3,670,950 | 6/1972 | Rossi | 229/40 |
| 3,679,121 | 7/1972 | Morgese | 229/40 |
| 3,705,681 | 12/1972 | Rossi | 229/40 |
| 3,986,658 | 10/1976 | Arneson | 229/40 |

*Primary Examiner*—Davis T. Moorhead
*Attorney, Agent, or Firm*—O'Brien & Marks

[57] ABSTRACT

A wrap-around article carrier adapted to carrying beverage containers has a lock portion located adjacent its top panels so that no outward load is felt on the lock itself. An end closure structure includes shade flaps which are automatically folded inward as lower tuck flaps are folded to raise the end of the carrier. A partition is included separating the articles and means are provided to hold the partition in place.

16 Claims, 8 Drawing Figures

FIG. 2
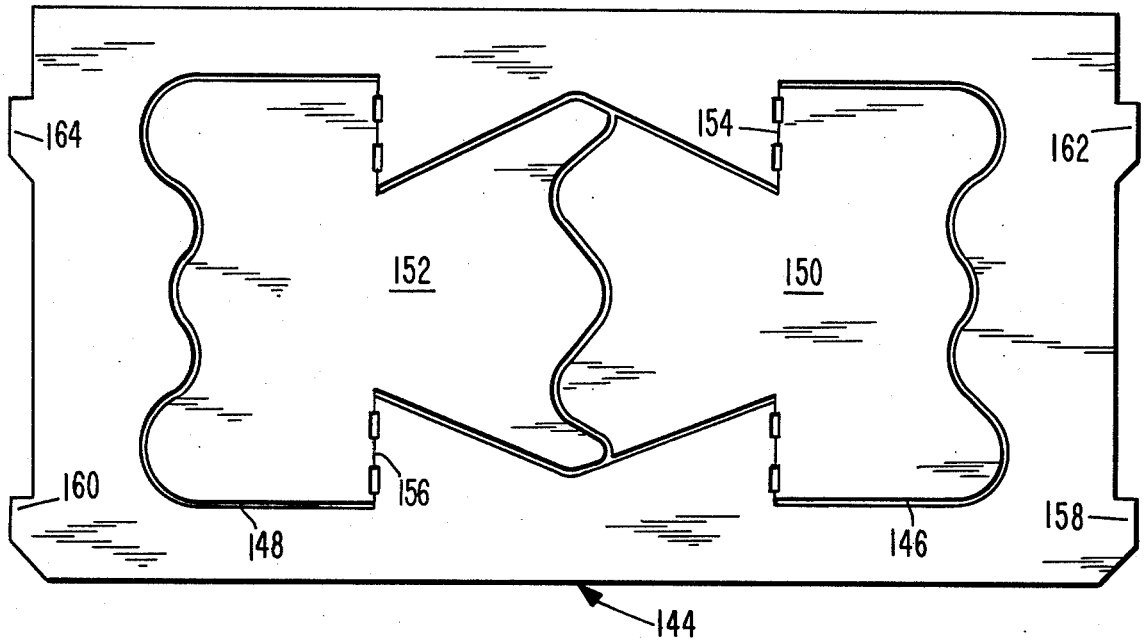
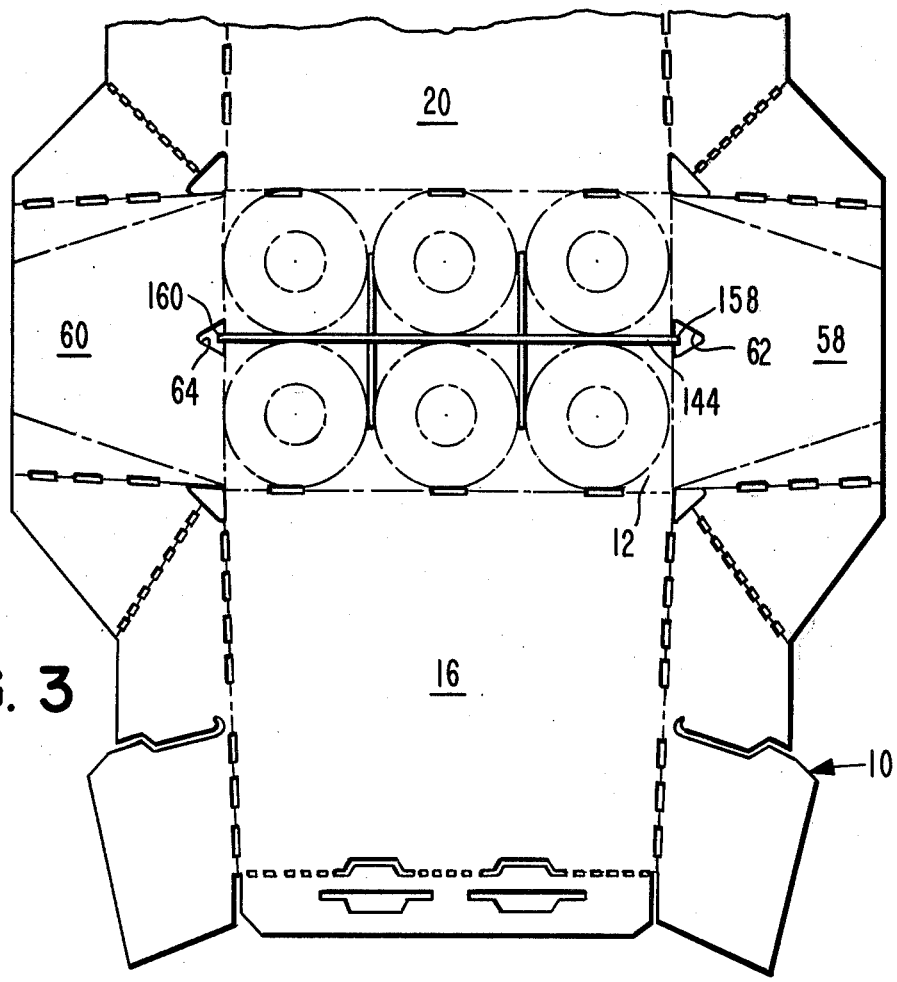
FIG. 3

FIG. 4
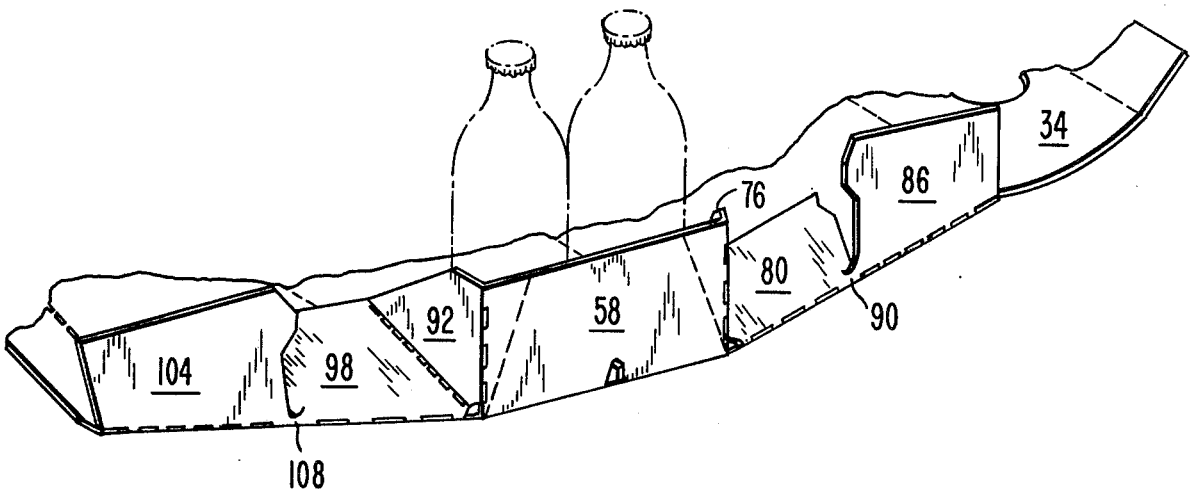
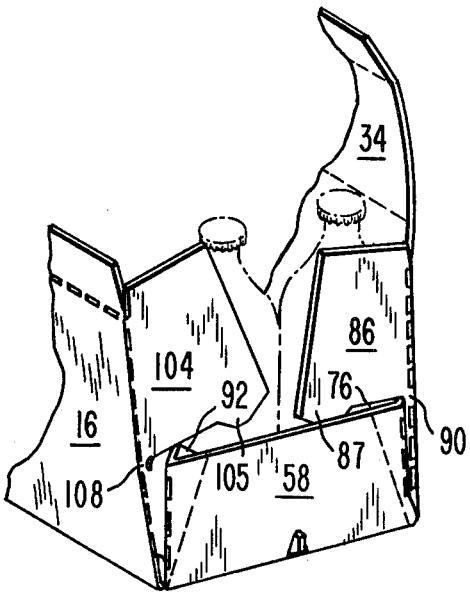
FIG. 5

FIG. 6
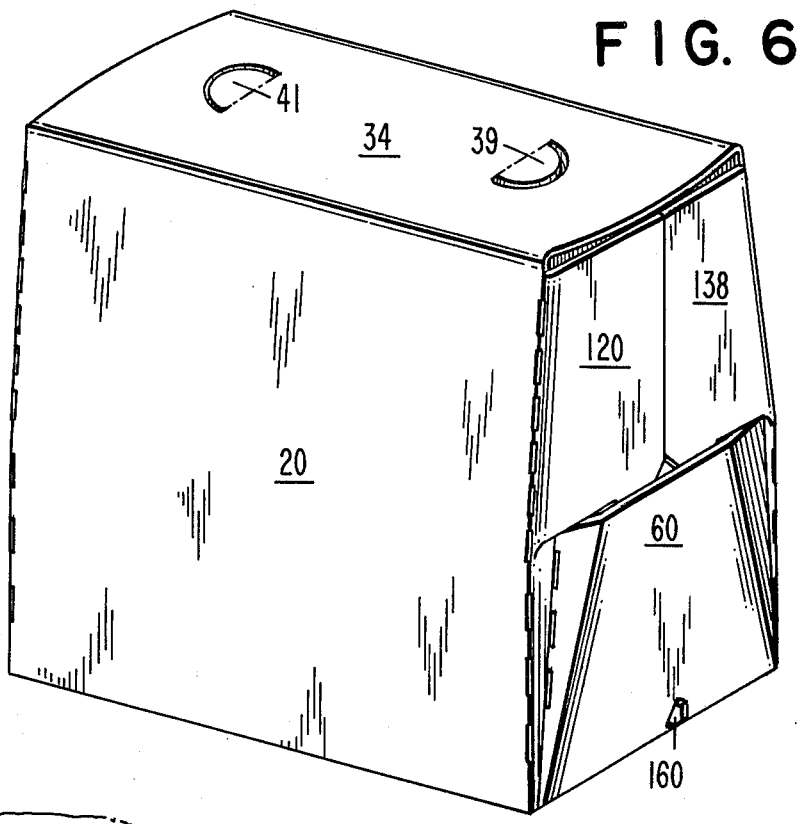
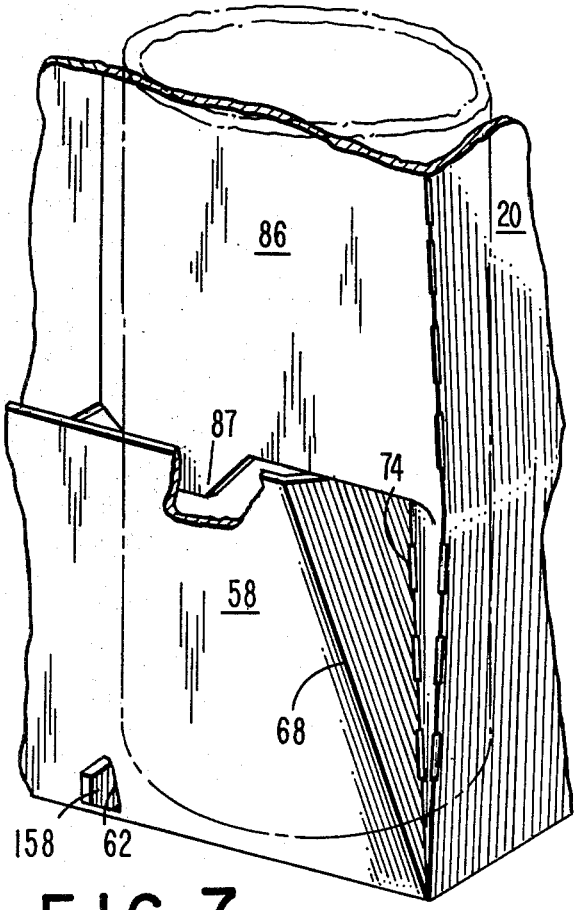
FIG. 7
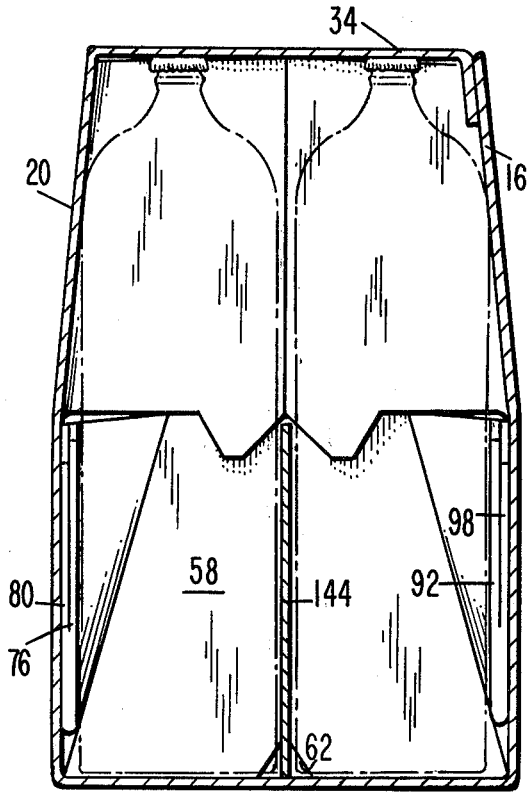
FIG. 8

ARTICLE CARRIER

BACKGROUND OF THE INVENTION

1. Field of the Invention

The present invention relates to article carriers and in particular to wrap-around carriers for beverage type containers.

2. Description of the Prior Art

The prior art is generally cognizant of wrap-around type carriers for beverage containers. Most of these wrap-around carriers have locking or gluing areas disposed on the bottom of the carrier. U.S. Pat. Nos. 2,889,040 and 3,014,636 show wrap-around type carriers that are glued on the side and locked on the top, respectively. Other article carriers have been proposed with flaps or tabs to retain the contents in the carrier. Examples of such carriers are shown in U.S. Pat. Nos. 2,849,111, 2,928,541, 2,936,069, and 3,679,121. U.S. Pat. Nos. 2,314,895 and 2,296,228 are examples of article carriers in which the retaining means is a flap which folds up from the bottom of the carrier. U.S. Pat. No. 3,670,950 is an example of a wrap-around carrier in which the entire end of the carrier is closed.

SUMMARY OF THE INVENTION

The present invention is summarized in that a wrap-around article carrier includes a bottom panel with two sides, first and second side panels extending upward from opposite sides of the bottom panel, a top panel extending across the top of the carrier and integral with the first side panel, carrying means provided in the top panel for carrying the carrier, a first lock panel extending from an edge of the top panel, and a second lock panel extending from the second side panel, the first and second lock panels being locked together to secure the carrier around the articles.

An object of the present invention is to provide a wrap-around article carrier in which the lock is positioned on the carrier so that no outward force is exerted on the lock by the articles being carried.

Another object of the present invention is to construct an article carrier in which the articles are retained in the carrier by end retaining flaps and are separated by a partition and in which the partition is automatically held in place.

Yet another object of the present invention is to provide such an article carrier further including shade flaps to seal the end of the carrier, the shade flaps being automatically folded in as other related flaps are folded into position.

Still another object of the present invention is to provide such an article carrier in which the end retaining flaps are foldable to conform to the shape of the articles in the carrier.

Other objects, advantages, and features of the present invention will become apparent from the following specification when taken in conjunction with the accompanying drawings.

BRIEF DESCRIPTION OF THE DRAWINGS

FIG. 2 is a plan view of a blank for a partition to be used with the blank of FIG. 1.

FIG. 3 is a plan view of the blanks of FIGS. 1 and 2 positioned with the articles to be carried by the carrier.

FIG. 4 shows a first step in the erection of the completed carrier from the blank of FIG. 1.

FIG. 5 shows a further step in the erection of the completed carrier from the blank of FIG. 1.

FIG. 6 is a perspective view of the completed carrier constructed according to the present invention.

FIG. 7 is a detailed perspective view of one corner of the carrier of FIG. 6.

FIG. 8 is an end view of the carrier of FIG. 6 taken from inside the carrier.

DESCRIPTION OF THE PREFERRED EMBODIMENT

Figure 1:
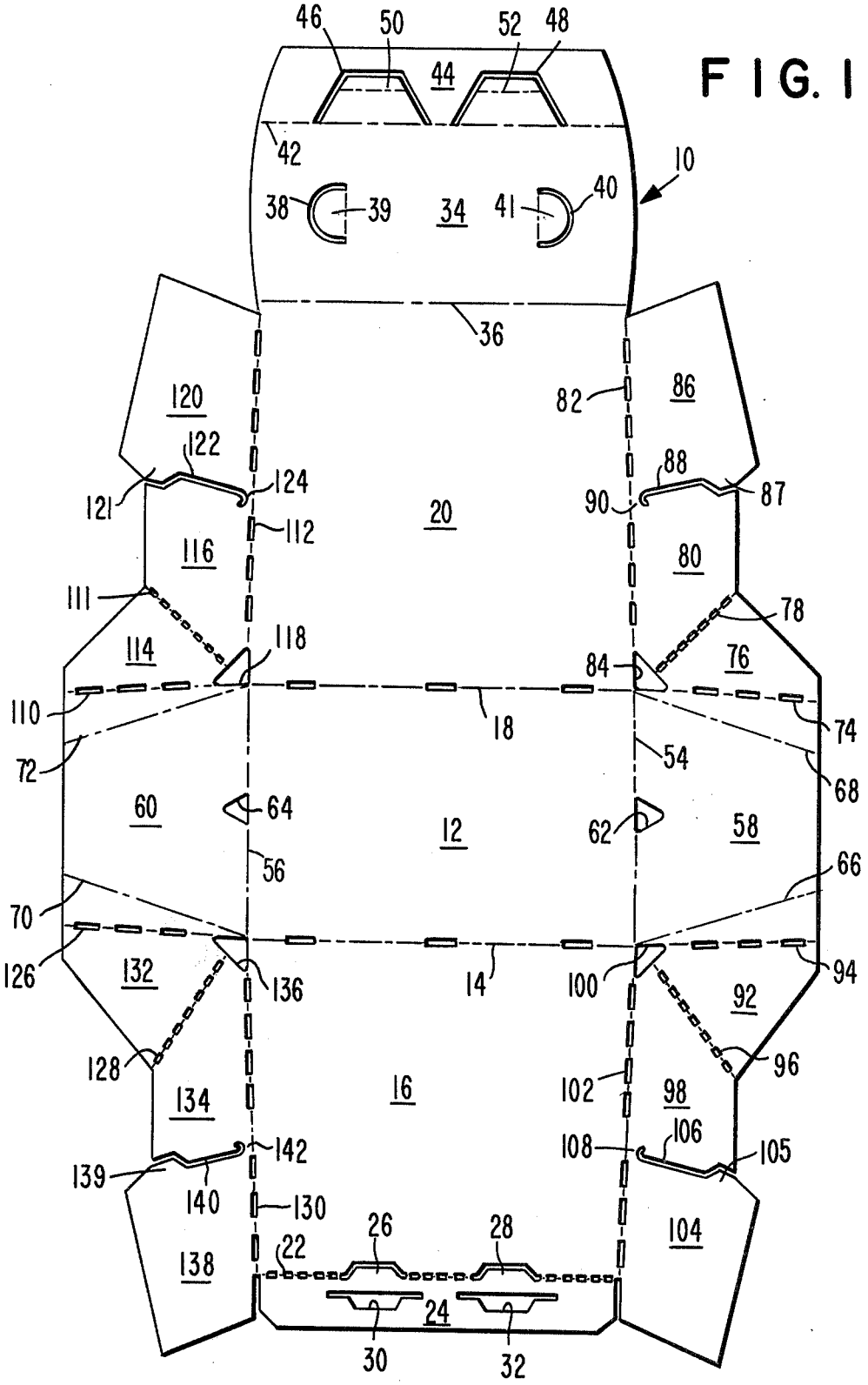
FIG. 1 is a plan view of the paperboard blank from which a carrier according to the present invention is constructed.

As is shown in FIG. 1, the present invention is embodied in a paperboard blank, generally indicated at 10, used to construct an article carrier. Centrally formed in the blank 10 is a generally rectangular carrier bottom panel 12. One of the long sides of the rectangle of the bottom panel 12 is formed by a scoreline 14 which connects the bottom panel 12 to a side panel 16. Along the other long side of the rectangle of the bottom panel 12, a scoreline 18 joins the bottom panel 12 to a side panel 20. Along its edge opposite from the bottom panel 12, the side panel 16 is bordered by a perforate scoreline 22 which joins it to a female lock panel 24. A pair of primary locking tabs 26 and 28 of the female lock panel 24 are formed by die cuts into the edge of the side panel 16. A pair of secondary locking cut-outs 30 and 32 are formed by die cuts through the female lock panel 24. Along its edge opposite from the bottom panel 12, the side panel 20 is joined to a carrier top panel 34 by a scoreline 36. A pair of carrier finger-hole die cuts 38 and 40 define push-in tabs 39 and 41 in the top panel 34. Along the edge of the top panel 34 opposite from the side panel 20 is a scoreline 42 which joins it to a male lock panel 44. A pair of die cuts in the male lock 44 define primary locking surfaces 46 and 48 and secondary locking tabs 50 and 52.

The short sides of the rectangle of the bottom panel 12 are defined by scorelines 54 and 56 which join respective end retaining flaps 58 and 60 to the bottom panel 12. Each of the end retaining flaps 58 and 60 has a respective one of partition retention holes 62 and 64 formed in it. The partition retention holes 62 and 64 are formed in the shape of elongate triangles with the short sides of the triangles lying along the scorelines 54 and 56. The end retaining flap 58 has formed in it imperforate bending scorelines 66 and 68 which are formed so that they slant inward toward the center of the end retaining flap 58 as they extend from adjacent the bottom panel 12 to the opposite edge of the end retaining flap. Similarly imperforate bending scorelines 70 and 72 are formed in the end retaining flap 60 extending from its edge adjacent the bottom panel 12 and slanting inward as they extend to the opposite edge of the end retaining flap 60. A scoreline 74 along the side edge of the end retaining flap 58 connects it to an end tuck flap 76 which has at its other edge a scoreline 78 connecting to a side tuck flap 80. The side tuck flap 80 is joined by a scoreline 82 to the side panel 20. A triangular recess 84 is formed by a die-cut into the blank 10 removing a portion of each of the end tuck flap 76 and the side tuck flap 80 adjacent their corners near the bottom panel 12. The scoreline 82 extends further along the edge of the side panel 20 to attach an end shade flap 86 to the side panel 20. The shade flap 86 is divided from the side tuck flap 80 by a die-cut 88 that terminates in a curved hook-shaped end close to, but not touching the scoreline 82. The die cut 88 also defines a shade flap tab 87 extending downward from the outside edge of the shade flap 86. A bridging region 90 is formed between the hooked end of the die-cut 88 and the scoreline 82 to connect the shade flap 86 to the side tuck flap 80. Similarly an end tuck flap 92 is formed between scorelines 94 and 96 which connect it to the end retaining flap 58 and a side tuck flap 98. A triangular recess 100 is cut from the side tuck flap 98 and the end tuck flap 92. A scoreline 102 connects the side panel 16 to the side tuck flap 98 and to a shadeflap 104 having a shade flap tab 105 extending therefrom. A die cut 106 extends between the shade flap 104 and the side tuck flap 98 terminates in a hook-shaped end which leaves a bridging region 108 between the hook-shaped end and the scoreline 102. Corresponding exactly to the tuck flaps 76, and 80, scorelines 110, 111, and 112 define an end tuck flap 114 and a side tuck flap 116 which attach to the end retaining flap 60 and the side panel 20 and which have a triangular recess 118 provided in them. A shade flap 120 with a shade flap tab 121 is separated from the side tuck flap 116 by a die-cut 122 which terminates in a hook-shaped end forming a bridging region 124 between it and the scoreline 112. Similarly scorelines 126, 128, and 130 define an end tuck flap 132 and a side tuck flap 134 between the side panel 16 and the end retaining flap 60, a triangular recess 136 being cut from the tuck flaps 132 and 134. A shade flap 138 with a shade flap tab 139 is separated from the side tuck flap 134 by a die-cut 140 which terminates in a hook-shaped end to define a bridging region 142.

Shown in FIG. 2 is a partition blank 144 for use with the carrier erected from the blank 10 of FIG. 1. The partition blank 144 is generally rectangular and has formed in it by die-cuts 146 and 148 movable portions 150 and 152 attached to the partition blank by scorelines 154 and 156. A pair of retention tabs 158 and 160 extend outward from the ends of the extreme lower edge of the partition blank 144. A pair of tabs 162 and 164 are formed also extending outward from the ends of the partition blank 144 further up toward the top edge thereof.

In the construction of the completed article carrier from the blank of FIG. 1, the articles to be contained in the carrier are first grouped and positioned so that the correct number of articles can be enclosed. Such grouping and positioning can be done manually, but is preferably done by automatic machines. As shown in FIG. 3, a number of articles in this case six beverage bottles, are positioned on the blank 10. The partition blank 144 has been placed between the bottles and the movable partitions 150 and 152 have been folded along the scorelines 154 and 156 so that each of the bottles has a part of the partition blank 144 between it and each adjacent bottle. The bottles and partition blank 144 are positioned over the bottom panel 12 of the blank 10.

Shown in FIG. 4 is the next subsequent step in folding the blank 10 around the bottles. This step, and all other subsequent assembly steps, may be performed either by hand or by machine even though the carrier of the present invention is particularly adapted for easy adaptation to the use of automatic assembly apparatus. The blank 10 is folded first along the scorelines 54 and 56 bringing the end retaining flaps 58 and 60 upward to a vertical position, as seen in FIG. 4. At the same time the respective pairs of tuck flaps 76 and 80, 92 and 98, 114 and 116, and 132 and 134 are folded upward along the scorelines 82, 102, 112 and 130 along with the end retaining flaps 58 and 60.

Next the side panels 16 and 20 are folded upward along the scorelines 14 and 18 to their positions as shown in FIG. 5. As the side panels 16 and 20 are folded upward, the side tuck flaps 80, 98, 116 and 134 are tucked inwardly so that the pairs of tuck flaps are folded relative to each other along the scorelines 78, 96, 111 and 128 to tuck the tuck flaps inside the carrier between the bottles to be carried and the side panels 16 and 20. Also as the side panels 16 and 20 are raised upward, the inwardly-folding side tuck flaps 80, 98, 116 and 134 perform an additional function. As the side tuck flaps 80, 98, 116 and 134 fold inwardly, they also, through the bridging portions 90, 108, 124 and 142, cause the shade flaps 86, 104, 120 and 138 to fold inward. Because of the die-cuts 88, 106, 122 and 140, the shade flaps 86, 104, 120 and 138 do not fold exactly along with the respective side tuck flaps, but are instead pulled along somewhat behind them. By appropriate sizing of the die-cuts 88, 106, 122 and 140 and of the bridging portions 90, 108, 124 and 142, the shade flaps 86, 104, 120 and 138 can be caused to be folded almost fully 90° or perpendicularly to the side panels 16 and 20 when the side tuck panels 80, 98, 116 and 134 are fully folded inwardly 180° so as to lie against and parallel to the side panels 16 and 20. Thus, as shown in FIG. 5, the shade flap tabs 87 and 105 of the shade flaps 86 and 104 are inserted behind the upper edge of the top of the end retaining panel 58 as the sides 16 and 20 are folded upward. Thus not only do the tuck flaps secure the ends of the carrier, as will be shown, they also, as they are folded, cause the shade flaps to be folded into correct position without any direct manipulation of the shade flaps themselves being necessary. This features is particularly advantageous in the present carrier inasmuch as it obviates the need for manipulation of the shade panels themselves, thereby allowing the automatic apparatus for assembly of the carrier to be of a simpler construction.

To complete the erection of the carrier, the top panel 34 is first folded over along the scoreline 36 to cover the top of the carrier, and then the male lock panel 44 is locked to the female lock panel 24 to secure the carrier in position. The lock is completed by first folding the male lock panel 44 downward along the scoreline 42 to a position inside of the female lock panel 24, with the secondary locking tabs 50 and 52 being folded up out of the way. Then the female lock panel 24 is bent along the scoreline 22 so that the primary locking tabs 26 and 28 slip inside the holes left by the secondary locking tabs 50 and 52 in the male lock panel 44 so that the primary locking tabs 26 and 28 abut the primary locking surfaces 46 and 48. Lastly the secondary locking tabs 50 and 52 are folded down and inserted into the secondary locking cut-outs 30 and 32 to complete the lock, thereby securing the blank 10 around the bottles in the form of the completed carrier of FIG. 6.

The completed carrier of FIG. 6 has its ends closed by the end retaining flaps 58 and 60 which are held in place by the tuck flaps 76, 80, 92, 98, 114, 116, 132 and 134 folded between the bottles and the side panels 16 and 20. The ends of the carton are further sealed to the light by the shade flaps 86, 104, 120 and 138 which are held in place by retention of the shade flap tabs 87, 105, 121 and 139 by the edges of the end retaining flaps 58 and 60. The locking of the lock panels 24 and 44 secures the top panel 34 and the side panels 16 and 20 tightly in place so that none of the other panels may move. The carrier can be lifted and carried by inserting fingers into the recesses formed by the die-cuts 38 and 40 around the push-in tabs 39 and 41 in the top panel 34.

In the completed carrier of FIG. 6, the placement of the lock formed between the lock panels 24 and 44 is particularly advantageous. In many conventional wrap-around carriers the lock is placed on the bottom of the container, and the outward pressure of the weight of the contents on the bottom of the carrier causes the lock to become worn and weak over a long period of time. With the lock placed adjacent the top panel 34 in the present carrier, this problem is avoided. As can be seen in FIG. 8, no portion of the bottles presses against this portion of the carrier. Thus the lock is subject only to tensional forces which are vertical in this case, and which tend to keep the lock tight so that it does not wear excessively.

Addition details of the ends of the carrier can be seen in FIGS. 7 and 8. As can be seen in FIG. 7, the tucking of the tuck flaps 76 and 80 and 92 and 98 has slightly folded the end retaining flap 58 so that its upper edge has a bend adjacent each of the end bottles in the carrier to further retain the end bottles in fixed position. The end retaining flap 58 bends along the imperforate scorelines 66 and 68 which are provided for this purpose. Thus if the carrier were to be tilted upward at its other end so that the end retaining flap 58 was at its lower end, the weight of the bottles would press downward, pressing harder against the central portion of the end retaining flap 58, thereby bending it slightly more along the scorelines 66 and 68 to pull the tuck flaps 76 and 80 and 92 and 98 in to tightly grasp the bottles to prevent any further movement. In this way because the end of the carrier now conforms to the shape of the bottles, any movement of the bottles becomes largely prevented.

As can be seen in FIGS. 7 and 8, as the end retaining flap 58 was folded upward, the partition retention hole 62 folded over the retention tab 158 on the partition blank 144. The partition retention hole 62 functions to abut the retention tab 158 so that together with the partition retention tab 160 at the other end the partition blank 144 is kept in place with the completed carrier. The triangular shape of the partition retention holes 62 and 64 ensures that the retention tabs 158 and 160 will be properly received in and centered within the partition retention holes 62 and 64 as the end retaining flaps 58 and 60 are folded upward. This retention of the retention tabs 158 and 160 in the partition retention holes 62 and 64 keeps the partition in place at all times within the carrier. This retention is accomplished automatically as the carrier is erected with no separate locking steps necessary and prevents completely any movement of the partition as the bottles are removed or replaced in the carrier.

As can be seen best in FIG. 8, the side panels 16 and 20 are bent as the blank 10 is locked around the bottles, the bend occuring in the general vicinity of the bridging regions 90, 108, 124 and 142. This bending is allowed by the die-cuts 88, 106, 122 and 140 so that the shade flaps can move relative to the side tuck flaps. The bending of the side panels 16 and 20 allows the blank 10 to be wrapped as tightly as possible around the bottles.

Inasmuch as the present invention is subject to many modification, variations, and changes in detail, it is intended that all material in the aforegoing specification or in the accompanying drawings be interpreted as illustrative and not in a limiting sense.

What is claimed is:

1. A wrap-around article carrier comprising
a bottom panel with two sides,
first and second side panels extending upward from opposite sides of the bottom panel,
a top panel extending across the top of the carrier and integral with the first side panel,
carrying means provided in the top panel for carrying the carrier,
a first lock panel extending from an edge of the top panel,
a second lock panel extending from the second side panel,
the first and second lock panels being locked together to secure the carrier around the articles,
end retaining flaps extending from the ends of the bottom panel, and
tuck flaps connecting the end retaining flaps to the side panels, the tuck flaps being folded and held between the articles in the carrier and the side panels to hold the end retaining flaps in a vertical position.

2. An article carrier comprising
a bottom panel with two sides and two ends,
a side panel upstanding from each side of the bottom panel,
carrying means for carrying the carrier,
an end retaining flap extending upward from each end of the bottom panel to close the ends of the carrier, each of the end retaining flaps having a partition retention hole defined therein,
a partition received inside the carrier for separating the articles therein, and
a retention tab formed on each end of the partition, each of the partition tabs being received in a respective one of the partition retention holes to keep the partition in place in the carrier.

3. An article carrier as claimed in claim 2 wherein
a pair of tuck flaps connect each end of each of the end retaining flaps to the side panels, the tuck flaps being folded in between the articles in the carrier and the side panels to keep the end retaining flaps in a vertical position.

4. An article carrier as claimed in claim 3 wherein each of the partition retention holes is of a triangular shape with one apex of the triangle directed vertically so that the partition retention holes fit over the retention tabs as the end retaining flaps are folded upward.

5. An article carrier as claimed in claim 2 wherein the retention tabs are formed along the extreme lower edge of the partition and wherein the partition retention holes are formed in the end retaining flaps adjacent the bottom panel.

6. An article carrier comprising
a bottom panel having two sides and two ends,
first and second side panels having vertical sides and extending upward from the sides of the bottom panel,
an end retaining flap extending from each end of the bottom panel,
a pair of tuck flaps connecting each of the end retaining flaps to each of the side panels, one of each pair of tuck flaps being a side tuck flap joined to the side panel and the other of each pair of tuck flaps being an end tuck flap joined to the end retaining flap, a shade flap attached to each side of each side panel; and a bridging region joining each of the shade flaps to a respective one of the side tuck flaps so that folding of the side tuck flaps also causes folding of the shade flaps.

7. An article carrier as claimed in claim 6 wherein each shade flap includes a shade flap tab, the shade flap tabs being retained by the end retaining flaps to close the shade flaps across each end of the carrier when the end retaining flaps are folded vertically.

8. An article carrier as claimed in claim 7 wherein the pair of tuck flaps fold together and are inserted between the articles in the carrier and the side panels to retain the end retaining flaps in a vertical position.

9. An article carrier as claimed in claim 7 wherein a top panel joins the first and second side panels to close the top of the carrier to light, the ends of the carrier being closed to light by the shade flaps and the end retaining flaps.

10. An article carrier as claimed in claim 9 wherein the top panel is narrower than the bottom panel so that the side panels are bent in the area of the bridging regions.

11. An article carrier as claimed in claim 6 wherein each of the shade flaps and the adjacent side tuck flaps are joined to the respective side panels by common scorelines, and wherein each of the shade flaps is separated from the adjacent side tuck flap by a die-cut which terminates so as to define the bridging region between the die-cut and the common scoreline.

12. An article carrier comprising a bottom panel with two sides and two ends, a side panel upstanding from each side of the bottom panel, an end retaining flap extending from each end of the bottom panel, a pair of tuck flaps connecting each end retaining flap to each side panel and foldable inward to raise the end retaining flaps upward, and a pair of scorelines formed in each end retaining flap so that each of the end retaining flaps can bend so that its upper edge will conform to the shape of the articles in the carrier.

13. An article carrier as claimed in claim 12 wherein a top panel connects the top edges of the side panels, and wherein carrying means are provided in the top panel.

14. An article carrier as claimed in claim 12 wherein the tuck flaps are tucked between the side panels and the articles in the carrier to keep the end retaining flap erect.

15. An article carrier as claimed in claim 12 wherein the scorelines are so formed in the end retaining flap that the bends in the end retaining flap are adjacent the tuck flaps on either side of the end retaining flap.

16. An article carrier as claimed in claim 15 further including shade flaps extending from the side panels and having shade flap tabs thereon, the shade flap tabs being formed on the extreme edge of the shade flaps so that the end retaining flaps can abut the shade flap tabs to retain the shade flaps in place closing the end of the carrier.

* * * * *

UNITED STATES PATENT OFFICE

CERTIFICATE OF CORRECTION

Patent No. 4,022,372 Dated May 10, 1977

Inventor(s) Earl J. Graser

It is certified that error appears in the above-identified patent and that said Letters Patent are hereby corrected as shown below:

Column 2, line 37, after the word "lock" insert the word -- panel --.

Column 3, line 14, after "98" insert the word -- and --.

Column 3, line 50, after the word "articles" insert a -- , --.

Column 4, line 37, delete the word "features" and insert in place thereof the word -- feature --.

Column 5, line 22, delete the word "Addition" and insert in place thereof the word -- Additional --.

Column 6, line 2, delete the word "modification" and insert in place thereof the word -- modifications --.

Column 6, line 22, delete the word "panel" and insert in place thereof the word -- panels --.

UNITED STATES PATENT OFFICE

CERTIFICATE OF CORRECTION

Patent No. 4,022,372 Dated May 10, 1977

Inventor(s) Earl J. Graser

It is certified that error appears in the above-identified patent and that said Letters Patent are hereby corrected as shown below:

Column 6, line 24, following the word side delete the word "panels" and insert in place thereof the word -- flaps --.

Column 6, line 24, following the word tuck delete the word "flaps" and insert in place thereof the word -- panels --.

Column 6, line 26, delete the word "flaps" and insert in place thereof the word -- panels --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*